US006002075A

United States Patent [19]

Carter

[11] Patent Number: 6,002,075

[45] Date of Patent: Dec. 14, 1999

[54] PITCH-CHANGING DEVICE FOR A PEDAL STEEL GUITAR

[75] Inventor: Mervin E. Carter, Mesquite, Tex.

[73] Assignee: World Class Steels, Inc., Mesquite, Tex.

[21] Appl. No.: 09/287,694

[22] Filed: Apr. 6, 1999

[51] Int. Cl.[6] ..... G10D 3/14

[52] U.S. Cl. ..... 84/312 P; 84/312 R

[58] Field of Search ..... 84/312 P, 312 R

[56] References Cited

U.S. PATENT DOCUMENTS

| | | | |
|---|---|---|---|
| 3,447,413 | 6/1969 | Lashley . | |
| 3,688,631 | 9/1972 | Jackson | 84/312 P |
| 4,080,864 | 3/1978 | Jackson . | |
| 4,175,467 | 11/1979 | Lashley . | |
| 5,044,247 | 9/1991 | Stepp . | |
| 5,092,214 | 3/1992 | Flynn . | |

*Primary Examiner*—Robert E. Nappi
*Assistant Examiner*—Shih-yung Hsieh

[57] ABSTRACT

A raising lever for a pedal steel guitar has a pin means for pivotal connection to a control bridge, a pivot means for pivotally attaching a lowering lever to the raising lever, and a raise attachment means for selectable attachment of a pull rod for actuation of the raising lever from a neutral position to an actuated position. A cabinet slot engaging portion remains in contact with a cabinet slot portion of the steel guitar when the raising lever is in the neutral position. The raise attachment has a raising flange integral to the raising lever and a plurality of holes for selectable connection of pull rods. A pitch-changing device to be used in a pedal steel guitar having the raising finger is also shown, as well as a pedal steel guitar employing the pitch changing device having the raised finger assembly.

12 Claims, 5 Drawing Sheets

PITCH-CHANGING DEVICE FOR A PEDAL STEEL GUITAR

BACKGROUND OF THE INVENTION

1. Field of the Invention

This invention relates generally to pedal steel guitars, and more particularly to an improved pitch-changing device.

2. Description of the Prior Art

The pedal steel guitar is a stringed instrument often having one or two necks, each normally utilizing from eight to fourteen strings. A pitch-changing mechanism or "changer" is actuated by a pedal or lever and used to raise and/or lower the pitch of the selected strings to achieve new chords and sounds. Each string is adjusted to a set pitch or open tuning, and changers can increase or decrease the tension on the selected strings, resulting in an alteration of pitch.

FIGS. 1, 2 and 3 depict a typical pitch-changing device employed in pedal steel guitars. FIG. 1 depicts a wrap around design in an all-pull pedal steel guitar showing the placement of the string, tension control lever, pitch raising and lowering levers, pull rods, return spring, and return stop. During operation as shown in FIG. 2, in raising the pitch of the string, a foot or knee activated pedal pulls a pull rod connected to a tuning nut which engages the pitch raising lever creating more tension on the string and thus raising the pitch of the selected string. After the pedal is released, the string tension brings the raising lever to return to the resting, neutral position by resting against a fixed return plate as depicted in FIG. 1. FIG. 3 shows a pull rod activating a lowering lever activated so that the raising lever behind may be shown in the resting, neutral position. A typical pedal steel guitar is shown and described in U.S. Pat. No. 5,092, 214, herein incorporated by reference.

After the pedal is released, the return spring causes the lowering lever to return to the resting, neutral position against the fixed return plate as depicted in FIG. 1.

Existing pitch-changers tend to require excessive and unnecessary movement to change string tension and also tend to return to the open, or "at rest" pitch imperfectly. Existing pitch changers have also suffered from excessive friction between the levers when changing tension on the strings.

To a large degree, the tonal quality of guitars is determined by the transmission of the string energy through the guitar. This includes transmission of energy through the various components of the guitar including the endplates, pitch changer, levers, keyheads, return stops, cabinet, etc.

BRIEF SUMMARY OF THE INVENTION

A primary advantage of the present invention is to improve tonal qualities of a pedal steel guitar.

Another advantage of the present invention is to provide a mechanism that directs the string energy more directly to the body of a pedal steel guitar.

Another advantage of the present invention is to provide a pitch-changing mechanism that returns the strings accurately to their original position.

Another advantage of the present invention is to reduce the friction between the components of the pitch changing mechanism during movement.

Other advantages of the present invention will become apparent from the following descriptions, taken in connection with the accompanying drawings, wherein, by way of illustration and example, an embodiment of the present invention is disclosed.

In the preferred embodiment, a cabinet slot engaging portion of the raising lever remains in substantially full contact with the guitar cabinet when the raising lever is in the non-actuated position. Also in the preferred embodiment, the raising lever is truncated below the raising flange so as to minimize the amount of frictional contact, or drag, with the lowering finger. Also in the preferred embodiment, the stop plate is aligned in generally vertical alignment with the edge of the cabinet slot that contacts the cabinet slot engaging portion of the raising lever.

In accordance with a preferred embodiment of the invention, a raising lever for a pedal steel guitar comprises a pin means for pivotal connection to a control bridge; a pivot means for pivotally attaching a lowering lever to the raising lever; a raise attachment means for selectable attachment of a pull rod for actuation of the raising lever from a neutral position to an actuated position, and; a cabinet slot engaging portion which remains in contact with a cabinet slot portion of the steel guitar when the raising lever is in the neutral position.

In accordance with another preferred embodiment of the invention, a pitch changing device for a pedal steel guitar comprises a raising lever pivotally connected to a bridge having a cabinet slot engaging portion which remains in immediate contact with a cabinet slot portion of a steel guitar when the raising lever is in a neutral position; and a lowering lever pivotally attached to the raising lever.

In accordance with another preferred embodiment of the invention, a pedal steel guitar comprises a guitar cabinet having a cabinet slot opening, a control bridge generally over the cabinet slot, a plurality of tension control levers pivotally connected to the bridge, a fret marker or fret board attached to the guitar cabinet; a plurality of strings mounted across the fret board, each of the strings secured at one end to an adjustable tuning key assembly and secured at it's opposite end to a control finger; one or more raising levers having a cabinet slot engaging portion in contact with at least a portion of the cabinet slot when in a neutral position; a plurality of lowering levers, a stop plate contacting the lower end of the lowering lever to define the neutral position, a plurality of pull rods each able to selectably actuate either a raising lever or a lowering lever for a predetermined, adjustable distance; and a plurality of return spring means for biasing each lowering lever to the neutral position.

BRIEF DESCRIPTION OF THE SEVERAL VIEWS OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE INVENTION

Description

Detailed description of the preferred embodiment is provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
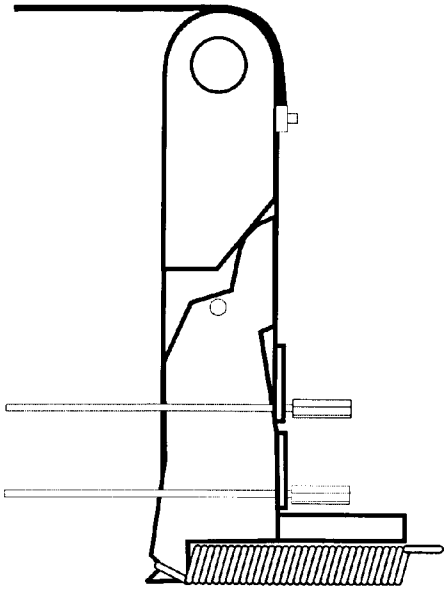
FIG. 1 PRIOR ART
FIG. 1 is a side view of a pitch-changing device in the neutral position in accordance with the prior art.
Figure 2:
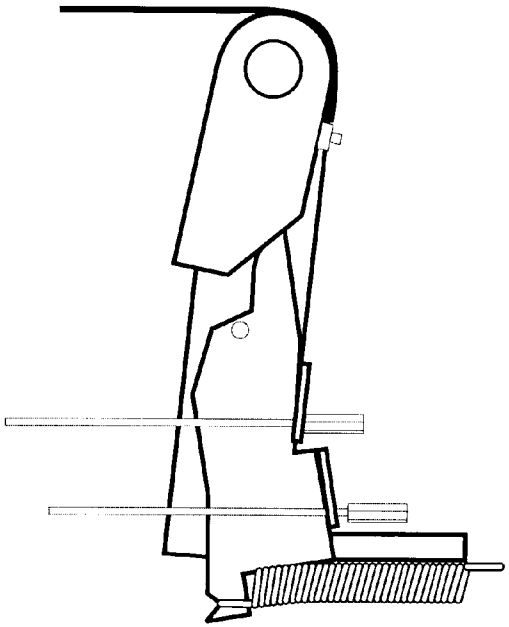
FIG. 2 PRIOR ART
FIG. 2 is a side view of a pitch-changing device in the raised position in accordance with the prior art.
Figure 3:
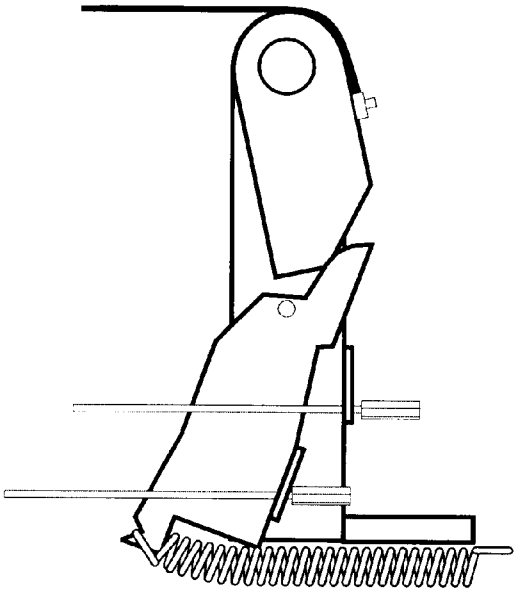
FIG. 3 PRIOR ART
FIG. 3 is a side view of a pitch-changing device in the lowered position in accordance with the prior art.
Figure 4:
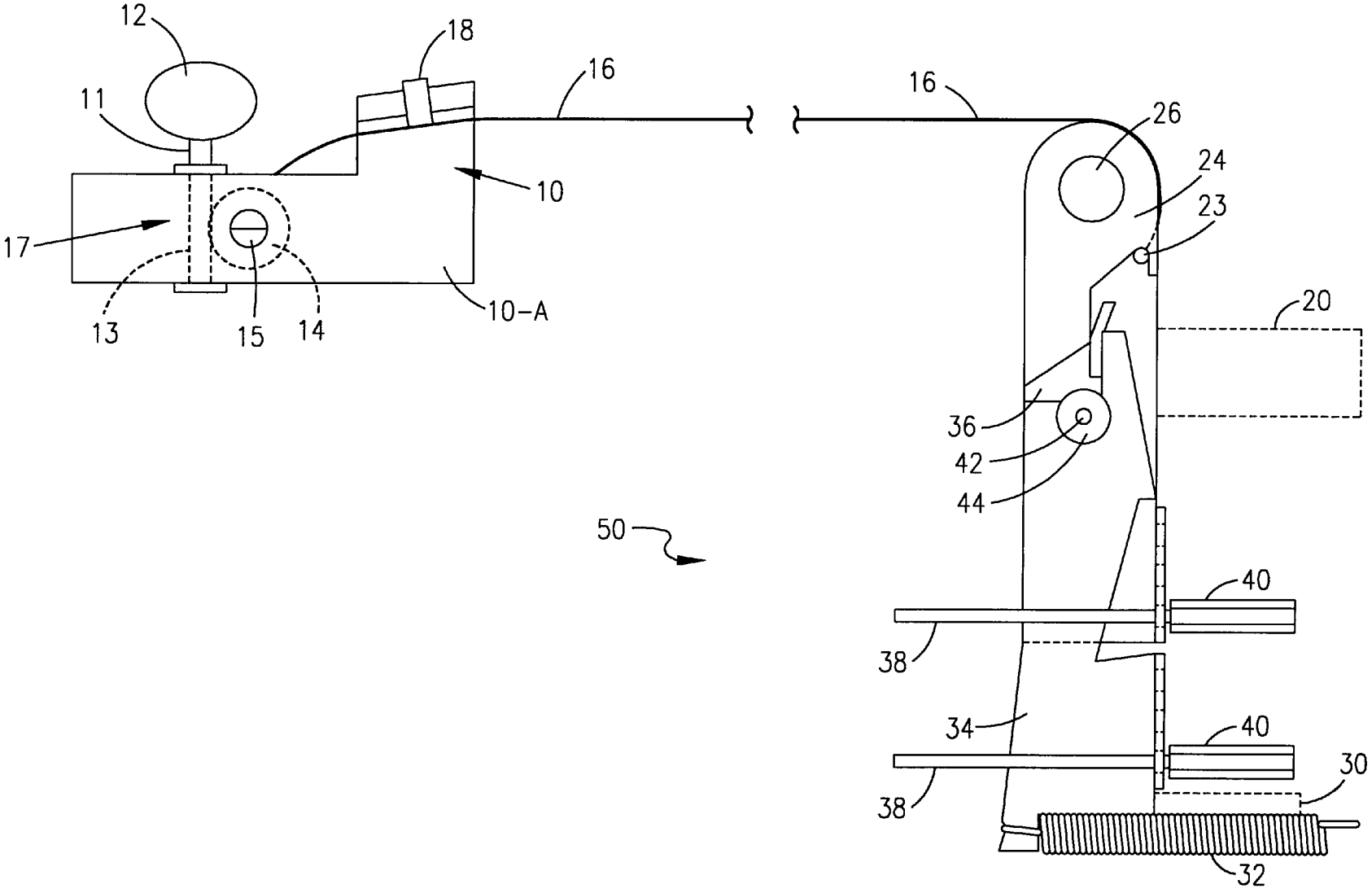
FIG. 4 is a side view of the pitch-changing device in accordance with an embodiment of the invention in the neutral position showing the guitar string connected to the keyhead of the pedal steel guitar.

Referring to FIG. 4, the reference numeral 50 generally designates the pitch-changing device in the neutral position showing the guitar string connected to the keyhead of the pedal steel guitar embodying features of the present invention. Pedal steel guitar 50 includes a guitar cabinet 20 which has at one end a keyhead assembly 10 to which tuning keys 17 are attached for adjustably securing one end of each of a plurality of strings 16. Strings 16 are stretched above a fret board 19, not shown but well know in the art. The opposite end of each string 16 is attached to a tension control lever 24 by a string attachment means 23.

Figure 5:
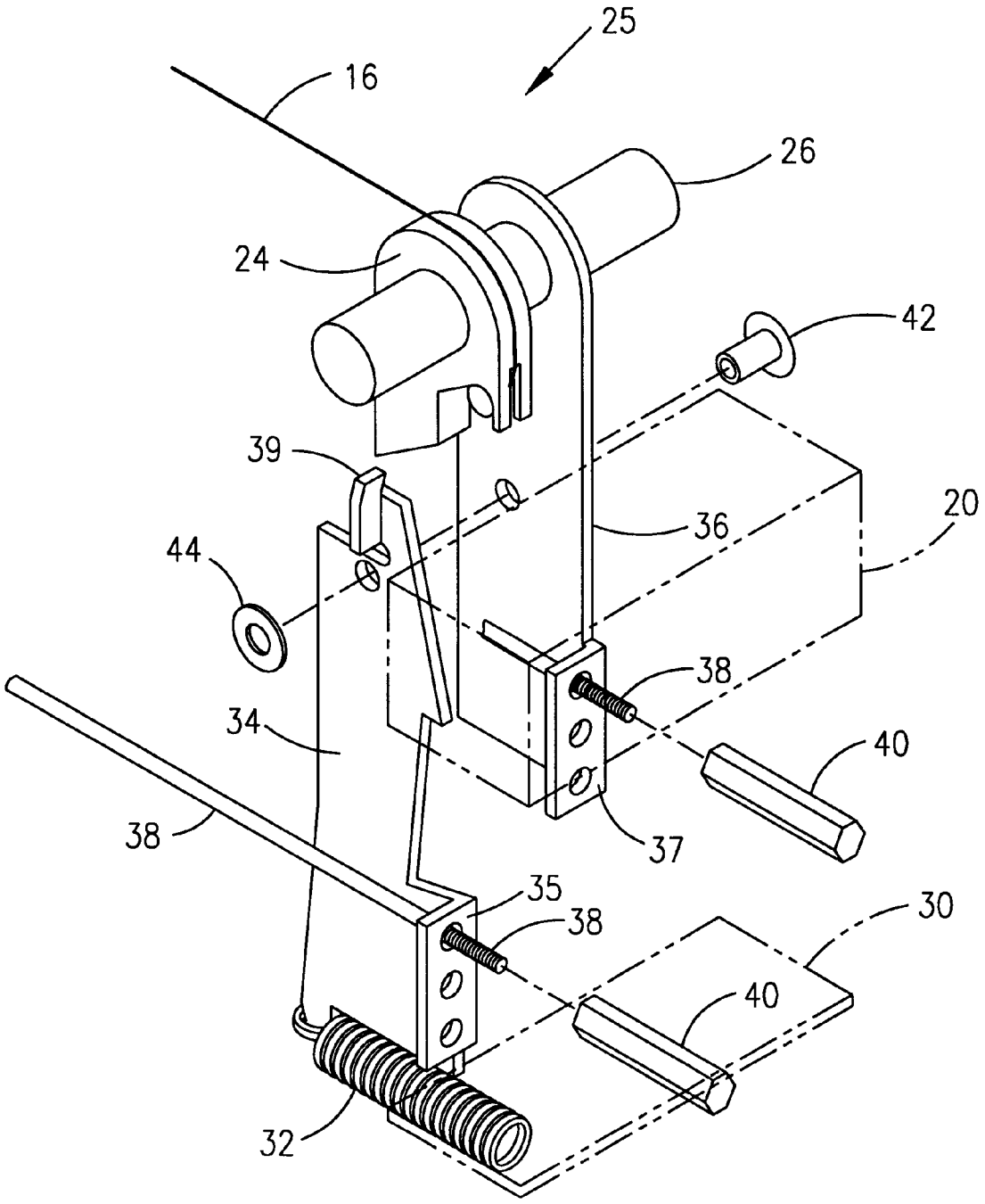
FIG. 5 is an isometric assembly drawing of the pitch-changing device in accordance with an embodiment of the invention, showing the three levers: a tension control lever; a raising; and a lowering lever.

Referring to FIG. 5, reference numeral 25 generally designates the pitch-changing device embodying features of the present invention. Control lever 24 is rotatively mounted on a bridge pin 26. A raising lever 36 is also rotatively mounted on bridge pin 26 and immediately adjacent to control lever 24. At the bottom of raising lever 36 is a raising flange 37 for selectable attachment of a pull rod 38. Pull rod 38 actuates raising lever 36 from a neutral position, shown in FIG. 6, to an actuated position, shown in FIG. 7. A tuning nut 40 is adjustably secured to pull rod 38 which, when activated, causes the tuning nut 40 to engage the raising flange 37. By adjusting threaded tuning nut 40, the distance raising lever 36 travels when actuated through the foot or knee pedal is adjusted, which in turn adjusts the change in pitch upon activation. A lowering lever 34 is pivotally mounted to raising lever 36 by a pivot rivet 42. On the top portion of, and integral to lowering lever 34, is a cam 39 for engaging and causing tensional rotation of tension control lever 24 when raising lever 36 is actuated.

Although the preferred illustrated embodiment includes a tension control lever, raising lever, and lowering lever, other embodiments are possible. For example, a single lever may be connected directly to the tension control lever by pivotal support, such as a rivet. This single lever can be made to have both raising and lowering flanges. Another possible alternate embodiment may have both separate raising and lowering levers connected by pivot means to each other. In this alternate embodiment, the raising finger is connected to the tension control lever by a pivot connection. In any embodiment, however, the raising pitch changing finger operates in relation to the cabinet guitar body in similar fashions to the referred embodiment described herein.

Figure 6:
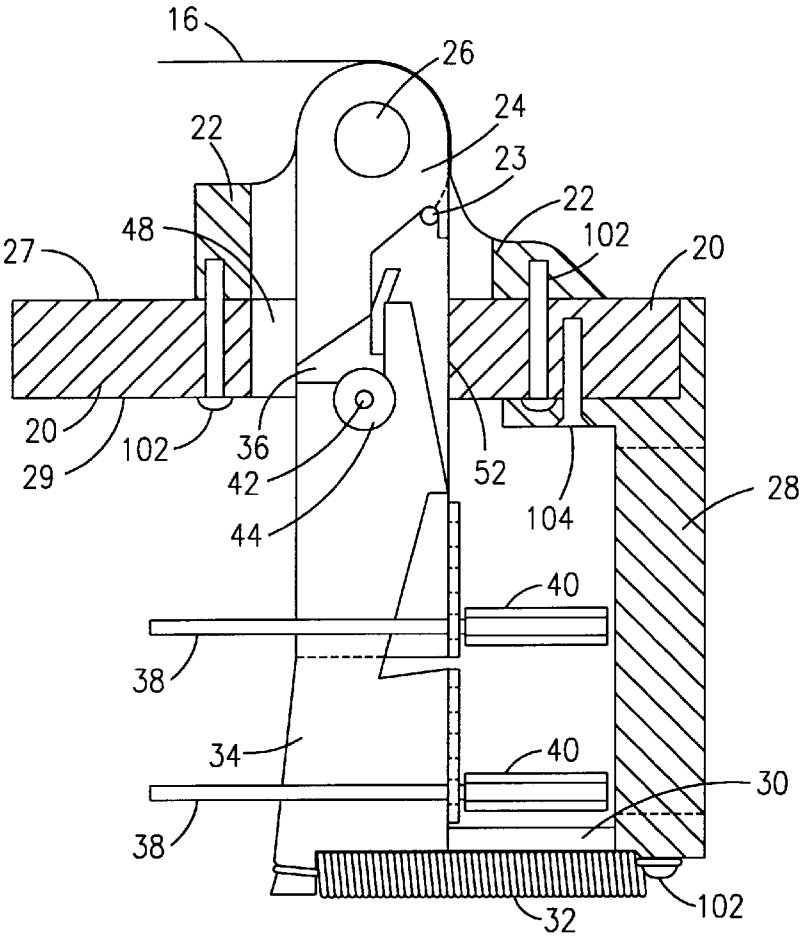
FIG. 6 is a view of the pitch-changing device in accordance with an embodiment of the invention in the neutral position positioned in a guitar cabinet slot with the raising lever in contact with the cabinet slot.
Figure 8:
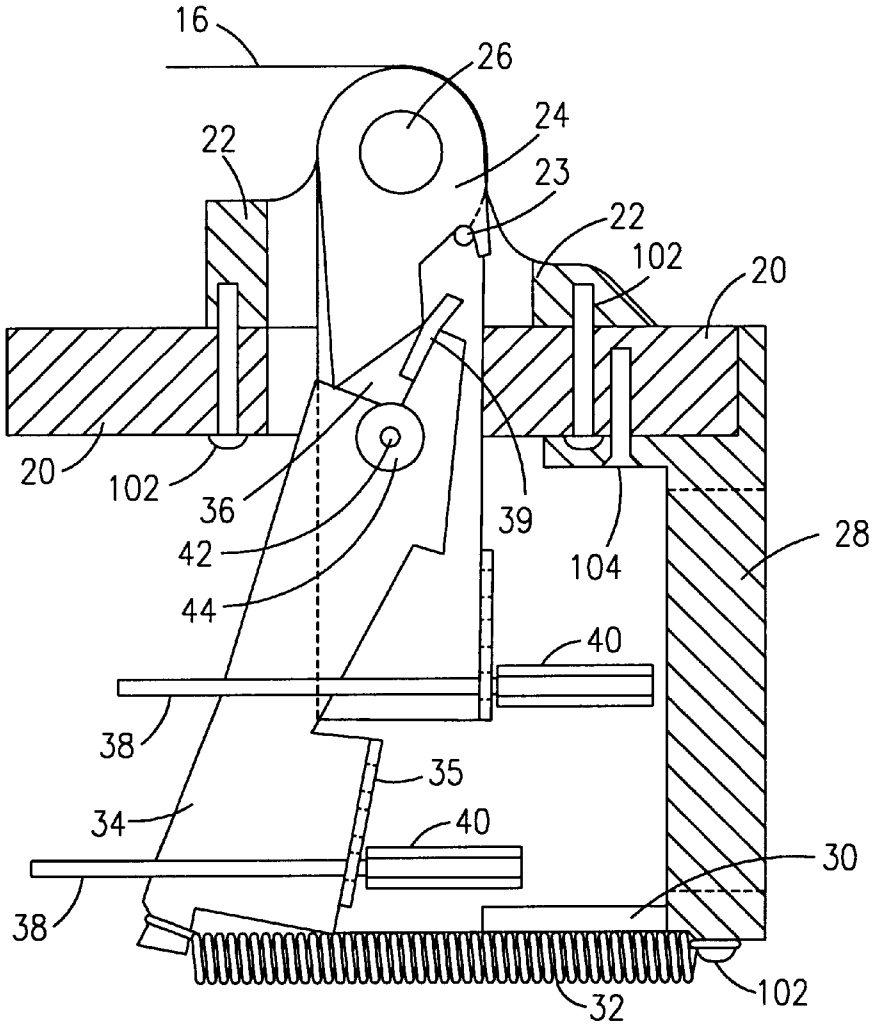
FIG. 8 is a side view of the pitch-changing device in accordance with an embodiment of the invention in the lowered position.

Continuing the description of the preferred illustrated embodiment, on the lower portion of lowering lever 34 is a lowering flange 35 for selectable attachment of a pull rod 38. Pull rod 38 actuates lowering lever 34 from a neutral position, as shown in FIG. 6, to an actuated position, as shown in FIG. 8. A tuning nut 40 is adjustably secured to pull rod 38 which, when activated, causes tuning nut 40 to engage lowering flange 35. A plurality of pull rod actuating means 45 (not shown, but well know in the art) are attached to the opposite end of each pull rod 38 for selective actuation of raising lever 36 or lowering lever 34 attached to pull rod 38 by the musician. Such actuating means may be of the type such as a foot or knee pedal well known in the art.

Referring to FIG. 6, guitar cabinet 20 having an upper surface 27 lower surface 29 is shown with raising lever 36 and lowering lever 34 both in a neutral or non-actuated position. Guitar cabinet 20 has a cabinet slot 48 through which tension control lever 24 is downwardly suspended from bridge pin 26. Bridge pin 26 is mounted in a control bridge 22, which is rigidly attached to guitar cabinet 20. In FIG. 6, a cabinet slot engaging portion 52 of raising lever 36 remains in substantially full contact with the edge of cabinet slot 48. A return spring 32 is attached at one end to the bottom of lowering lever 34. Return spring 32 is rigidly attached at its opposite end to a stop plate 30. Return spring 32 may alternatively be attached to an end plate 28 or to a spring adjustment means 60 (not shown), or another rigid fixture which is in turn, rigidly attached to guitar cabinet 20 or end plate 28.

Figure 7:
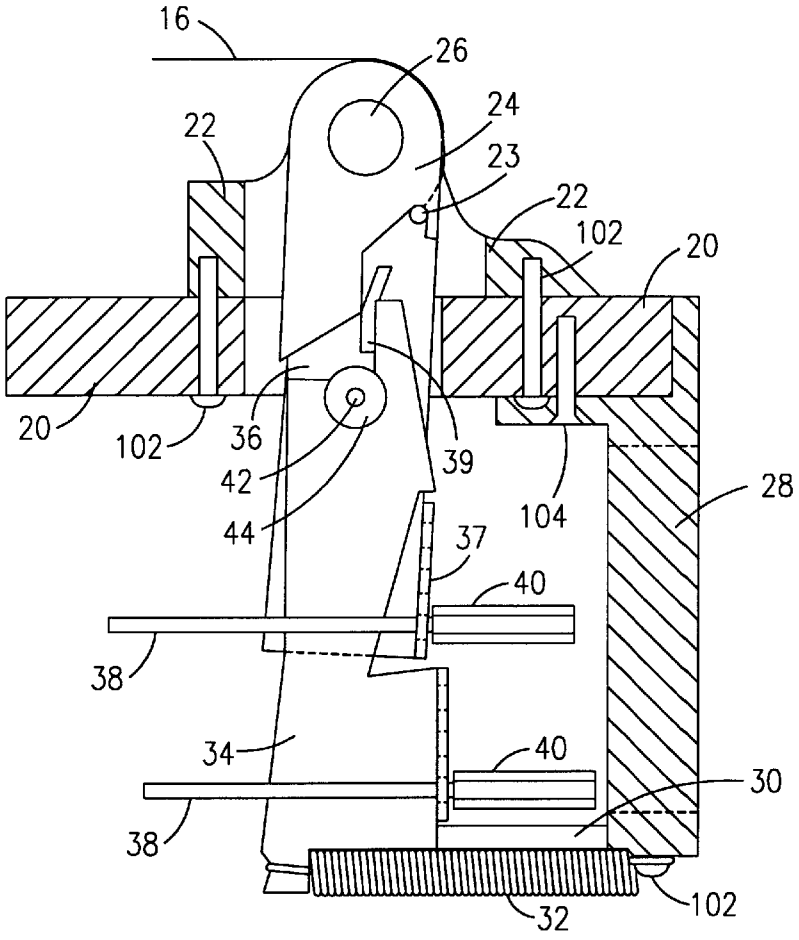
FIG. 7 is a side view of the pitch-changing device in accordance with an embodiment of the invention in the raised position.

Referring to FIG. 7, guitar cabinet 20 is shown with raising lever 36 in the actuated position and lowering lever 34 the non-actuated position. In this position, cam 39 generates tensional increasing rotation of tension control lever 24.

Referring to FIG. 8, guitar cabinet 20 is shown with raising lever 36 in the non-actuated position and lowering lever 34 the actuated position. In this position, cam 39 generates tensional decreasing rotation of tension control lever 24.

Operation

Each of strings 16 on pedal steel guitar 50 are attached on one end to a tuning key 17. Tuning key 17 provides tensional adjustment of strings 16 to bring them into open-tuning pitch. The opposite end of strings 16 are attached by string attachment means 23 to tension control lever 24. Open-pitch tuning of a string 16 occurs when raising lever 36 and lowering lever 34 are both in the neutral, non-actuated position as shown in FIG. 6. In the neutral position, raising lever 36 is not actuated, and cabinet slot engaging portion 52 of raising lever 36 is in substantially full contact with cabinet slot 48, thus imparting the string harmonics directly into guitar cabinet 20 when string 16 is played. In the neutral position, lowering lever 34 is not actuated and remains anchored by return spring 32 to the stop plate 30.

When the musician desires to increase the pitch of a string 16, the proper pull rod actuating means 46 is manually activated by selecting and actuating an associated foot pedal or knee lever. When actuated, pull rod 38 then causes threaded tuning nut 40 to engage raising flange 37. When actuated, pull rod 38 causes actuation by rotation of raising lever 36 about bridge pin 26. Pivot means 42 attachment of raising lever 36 to lowering lever 34 causes a coincidental counter-rotation of lowering lever 34. During this rotation, lowering lever 34 remains held against stop plate 30 by return spring 32, whereby stop plate 30 provides fulcrum load bearing of lowering lever 34. As lowering lever 34 is counter-rotated, cam 39 engages tension control lever 24, causing tensional increasing rotation of tension control lever 24. This rotation increases the tension of string 16, thus achieving the desired increased pitch.

When the musician desires to decrease the pitch of a string 16, he manually activates the proper pull rod actuating means 46. When actuated, pull rod 38 then causes threaded tuning nut 40 to engage lowering flange 35. When actuated, pull rod 38 causes actuation by rotation of lowering lever 34 about pivot means 42. In this rotation, lowering lever 34 departs from contact with stop plate 30, and return spring 32 is expanded. Raising lever 36 remains in the non-actuated position, and in direct contact with guitar cabinet 20. As lowering lever 34 is rotated, cam 39 engages tension control lever 24, causing tensional decreasing rotation of tension control lever 24. This rotation decreases the tension of string 16, thus achieving the desired decreased pitch.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

I claim:

1. A raising lever for an all-pull pedal steel guitar comprising:

a means for pivotal connection to a control bridge;

a means for selective attachment of a pull rod to actuate the raising lever from a neutral position to an actuated position, and;

a portion that remains in contact with a cabinet slot portion of the steel guitar when the raising lever is in the neutral position.

2. A raising lever for a pedal steel guitar as claimed in claim 1 further comprising:

a pivot means for pivotally attaching a lowering lever to the raising lever.

3. The raising lever as claimed in claim 1 further comprising:

a raising flange associated with the raising lever having a plurality of engagement sections for selective connection of a pull rod.

4. The raising lever as claimed in claim 3 wherein the raising lever does not extend below the bottom of the raising flange.

5. A pitch-changing device for an all-pull pedal steel guitar having a guitar cabinet with a cabinet slot, the pitch-changing device comprising:

a tension control lever connected to a control bridge with a string attachment means;

a lowering pitch changing lever;

a pivot means for pivotally attaching the lowering lever to a raising lever.

a raising pitch changing lever pivotally attached to the lowering lever and connected to the control bridge; the raising lever being selectively attachable to a pull rod to actuate the raising lever from a neutral position to an actuated position, and includes a portion that remains in contact with a cabinet slot portion of the steel guitar when the raising lever is in the neutral position.

6. The pitch changing device as claimed in claim 5 further comprising:

a raising flange associated with the raising lever having a plurality of engagement sections for selective connection of the associated pull rod.

7. The pitch-changing device as claimed in claim 5, wherein the raising lever does not extend below the bottom of the raise flange.

8. An all-pull pedal steel guitar comprising:

a guitar cabinet, having an upper surface and an opposite lower surface, and having a cabinet slot at one end between the upper surface and the lower surface;

a control bridge mounted to the upper surface of the guitar cabinet, and located about the cabinet slot;

a plurality of tension control levers pivotally connected to the bridge, the control levers having a string attachment means;

a fret board attached to the upper surface of the guitar cabinet;

a plurality of strings mounted across the fret board, each of the strings secured at one end to a keyhead, each of the strings secured at its opposite end to a control lever;

a plurality of raising levers extending through the cabinet slot opening, each of the raising levers pivotally connected to the bridge, each of the raising levers being adjacent to a control lever, each raising lever having a cabinet slot engaging portion which remains in immediate contact with the cabinet slot opening of the steel guitar when the raising lever is in the neutral position;

a raise attachment means for selectable attachment of a pull rod for actuation of each of the raising levers from the neutral position to an actuated position;

a plurality of lowering levers, each of the lowering levers pivotally attached to a raising lever, each lowering lever positioned against a stop plate in the neutral position;

a lower attachment means for selectable attachment of a pull rod for actuation of each of the lowering levers from the neutral position to the actuated position;

the stop plate in generally vertical alignment with an outer most edge of the cabinet slot and being rigidly attached to the steel guitar, the stop plate oriented generally perpendicular to the lowering lever in the neutral position, the stop plate contacting the lower end of the lowering lever to define the neutral position;

a plurality of pull rods, each pull rod selectably attachable to either the raising lever or the lowering lever for actuating the selected lever;

a plurality of return spring means for biasing each of the lowering levers against the stop plate when an adjacent raising lever is actuated, the return spring means biasing each of the lowering levers against the stop plate when the raising lever and an adjacent lowering lever are in the neutral position, the return spring means urging each of the lowering levers to the neutral position against the stop plate when released from the actuated position;

a cam, integral to the lowering lever, the cam engaging the control lever for selective rotational positioning of the control lever, the cam generating tensional reducing rotation of the control lever when the lowering lever is actuated, the cam generating tensional increasing rotation of the control lever when the raising lever is actuated, and;

a plurality of pull rod actuating means, each pull rod actuating means attachable for selective movement of the pull rods.

9. A pedal steel guitar as claimed in claim 8 in which the raise attachment means further comprises:

a raising flange, the raise flange being integral to the raising lever, the raising flange being in right angle relation to the cabinet slot engaging portion, the raising flange having a plurality of holes for selectable connection of the pull rod.

10. A pedal steel guitar as claimed in claim 8 wherein the lower attachment means further comprises a lowering flange, the lower flange being integral to the lowering lever, the lowering flange being in right angle relation to the cabinet slot engaging portion, the lowering flange having a plurality of holes for selectable connection of the pull rod.

11. A pedal steel guitar as claimed in claim 8 wherein the return spring means further comprises a plurality of return springs, each spring attached on one end to the lower portion of a lowering lever, each spring attached on its opposite end to the steel guitar, each string urging a lowering lever against the stop plate.

12. A raising lever as claimed in claim 9 wherein the raising lever does not extend below the bottom of the raise flange.

* * * * *